US006996920B2

(12) United States Patent
Bang et al.

(10) Patent No.: US 6,996,920 B2
(45) Date of Patent: Feb. 14, 2006

(54) CONTROL METHOD AND SYSTEM FOR CLOTHES DRYER

(75) Inventors: Jong Chul Bang, Changwon-si (KR); Sang Ho Park, Changwon-si (KR); Tae In Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/872,479

(22) Filed: Jun. 22, 2004

(65) Prior Publication Data

US 2005/0016013 A1 Jan. 27, 2005

(30) Foreign Application Priority Data

Jul. 25, 2003 (KR) ..... P 10-2003-0051346
Jul. 25, 2003 (KR) ..... P 10-2003-0051351
Aug. 26, 2003 (KR) ..... P 10-2003-0059060

(51) Int. Cl.
*F26B 3/00* (2006.01)

(52) U.S. Cl. ..... 34/494; 34/529; 34/572; 34/601

(58) Field of Classification Search ..... 34/261, 34/318, 445, 446, 447, 494, 499, 529, 531, 34/572, 87, 88, 116, 601, 602, 603
See application file for complete search history.

(56) References Cited

U.S. PATENT DOCUMENTS 3,890,719 A * 6/1975 Braga et al. ..... 34/572
4,488,363 A * 12/1984 Jackson et al. ..... 34/572
5,852,881 A * 12/1998 Kuroda et al. ..... 34/527
6,637,127 B2 * 10/2003 Reede et al. ..... 34/527

* cited by examiner

*Primary Examiner*—Kenneth Rinehart
(74) *Attorney, Agent, or Firm*—McKenna Long & Aldridge LLP

(57) ABSTRACT

A control method and system for a belt-driven clothes dryer are disclosed. The control system includes a drum containing a load of wet clothes to be dried, a heater heating air flowing into the drum, a motor coupled to the drum by a power transmission system for rotating the drum, and a power supply supplying power to the motor and the heater during a dry operation of the dryer. The control system further includes a moisture sensor outputting a sensor signal during the dry operation, or a photo coupler outputting voltage pulses when the motor is in operation during the dry operation. Then, a microprocessor included in the control system detects a breakage of the power transmission system upon analyzing the sensor signal of the moisture sensor or the voltage pulses generated by the photo coupler. If the microprocessor detects such breakage, it interrupts the dry operation of the clothes dryer.

10 Claims, 10 Drawing Sheets

CONTROL METHOD AND SYSTEM FOR CLOTHES DRYER

This application claims the benefit of Korean Patent Application No. P2003-0051346 filed on Jul. 25, 2003, Korean Patent Application No. P2003-0051351 filed on Jul. 25, 2003, and Korean Patent Application No. P2003-0059060 filed on Aug. 26, 2003, which are hereby incorporated by reference.

BACKGROUND OF THE INVENTION

1. Field of the Invention

The present invention relates to a dryer, and more particularly, to a control method and system for a belt-driven clothes dryer that are able to automatically detect a breakage of a power transmission system coupled between a drum and a motor included in the dryer.

2. Discussion of the Related Art

A dryer is a device that automatically dries wet objects (e.g., clothes or shoes) by providing heated air under the control of a controller, and smarter and more efficient dryers that are able to meet the users' various requirements are in great demand. In general, a typical clothes dryer includes a tub (drum) containing the wet objects to be dried, a motor, and a power transmission system which is coupled between the motor and the drum for transmitting the power generated by the motor during a dry operation of the dryer. During the dry operation, the heated air flows into the drum and the drum continuously rotates so that the wet clothes inside of the drum could be dried. The moisturized air within the drum is continuously discharged from the drum and heated dry air flows into the drum simultaneously, while the drum rotates in the dry operation.

If there is a breakage in the power transmission system coupled between the motor and the drum, this could result very serious damages to the dryer and the objects within the drum. For example, if electric power is continuously supplied to the motor and the heater when a belt coupled between the motor and the drum for power transmission is broken, there is no motion of the drum and the objects within the drum. Therefore, the heated air will continuously make contact with same portions of the objects for a long time, and this could result serious damages to the objects. In order to substantially obviate the problems due to these limitations and disadvantages, many dryer manufactures have been trying to make clothes dryers capable of automatically detecting a breakage of the power transmission system and controlling operation of the dryer based on such breakage detection.

One of the examples of the existing breakage-detectable clothes dryers includes a mechanical breakage detection assembly including an arm which mechanically moves when the belt provided between the motor and the drum is broken, and a switch which automatically shuts off the power supply to the motor based on the motion of the arm. However, this detection assembly requires a complicated mechanical structure. For example, the arm must be provided at a predefined location within the dryer so as to accurately detect the breakage of the belt, and this could create a serious structural limitation when manufacturing the dryer. In addition, a slight dislocation of the switch which operates due to the rotation of the arm could result malfunction of the breakage detection assembly. Therefore, there are great necessities for a control system and method for a clothes dryer, which are able to detect the breakage of the power transmission system without requiring any complicate mechanical system.

SUMMARY OF THE INVENTION

Accordingly, the present invention is directed to a control method and system for a belt-driven clothes dryer that substantially obviates one or more problems due to limitations and disadvantages of the related art.

An object of the present invention is to provide a control method for a clothes dryer, which is able to detect a breakage of a power transmission system included in the dryer and to control the dry operation of the dryer based on the breakage detection.

Another object of the present invention is to provide a control system for a clothes dryer, which is able to detect a breakage of a power transmission system included in the dryer and to control the dry operation of the dryer based on the breakage detection.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method for a clothe dryer according to a first embodiment of the present invention includes the steps of performing a dry operation of the clothes dryer by supplying power to a motor for rotating a drum containing a load of wet clothes and to a heater for heating air flowing into the drum, which is coupled to a power transmission system driven by the motor, and receiving a sensor signal outputted from a moisture sensor provided within the drum during the dry operation. The moisture sensor outputs a voltage pulse each time it makes contact with the wet clothes during the dry operation. The control method further includes the steps of detecting a breakage of the power transmission system based upon analyzing the sensor signal, and interrupting the dry operation of the clothes dryer if the breakage of the power transmission system is detected. The breakage may be detected if the sensor signal received from the moisture sensor for a predetermined time includes no voltage pulse.

In another aspect of the present invention, a control system for a clothes dryer according to the first embodiment of the present invention includes a drum containing a load of wet clothes to be dried, a heater configured to heat air flowing into the drum so as to dry the wet clothes, a motor coupled to the drum by a power transmission system such as a belt for rotating the drum, and a driving unit supplying power to the motor and the heater during a dry operation of the clothes dryer. The control system further includes a moisture sensor provided within the drum for outputting a sensor signal, and a microprocessor configured to detect a breakage of the power transmission system based upon analyzing the sensor signal received from the moisture sensor. The moisture sensor outputs a voltage pulse each time it makes contact with the wet clothes during the dry operation. Then the microprocessor detects the breakage of the power transmission system if the sensor signal includes no voltage pulse for a predetermined time.

In another aspect of the present invention, a control method for a clothes dryer according to a second embodiment of the present invention includes the steps of performing a dry operation of the clothes dryer by supplying power to a motor for rotating a drum containing a load of wet clothes and to a heater heating air flowing into the drum, which is coupled to a power transmission system driven by the motor, and receiving voltage pulses which are outputted from a photo coupler coupled to the motor when the motor is in operation during the dry operation. The control method further includes the steps of detecting a breakage of the power transmission system based upon analyzing the voltage pulses, and interrupting the dry operation of the clothes dryer if the breakage of the power transmission system is detected. The breakage of the power transmission may be detected if a pulse width of the voltage pulses is less than a reference pulse width, or if a frequency of the voltage pulses is greater than a reference frequency.

In another aspect of the present invention, a control system for a clothes dryer according to the second embodiment of the present invention includes a drum containing a load of wet clothes to be dried, a heater configured to heat air flowing into the drum, and a motor mechanically coupled to the drum by a power transmission system for rotating the drum. The control system further includes a power supply configured to supply power to the motor and the heater during a dry operation of the clothes dryer, a photo coupler which outputs voltage pulses when the motor is in operation during the dry operation, and a microprocessor which detects a breakage of the power transmission system based upon analyzing the voltage pulses outputted from the photo coupler. The microprocessor interrupts the dry operation of the clothes dryer if the breakage of the power transmission system is detected.

In another aspect of the present invention, a control method for clothes dryer according to a third embodiment of the present invention includes the steps of initiating a dry operation of the clothes dryer by performing a pre-dry operation. During the pre-dry operation, power is supplied to a motor for predetermined time so as to accelerate a drum containing a load of wet clothes and the power is shut off thereafter, where the drum is coupled to a power transmission system driven by the motor. The control method further includes the steps of measuring a counter electromotive force generated by the motor during the pre-dry operation, detecting a breakage of the power transmission system if the measured counter electromotive force is greater than a reference level, and interrupting the dry operation of the clothes dryer if the breakage of the power transmission system is detected. The control method may further include the step of performing a main dry operation of the clothes dryer by supplying power to the motor and a heater only if no breakage of the power transmission system is detected during the pre-dry operation, where the heater is configured to heat air flowing into the drum. In addition, the counter electromotive force is measured based on a frequency of voltage pulses outputted from a photo coupler coupled to the motor. The voltage pulses are outputted when the motor is in operation during the pre-dry operation.

In another aspect of the present invention, a control system for clothes dryer according to the third embodiment of the present invention includes a drum containing a load of wet clothes to be dried, a motor mechanically coupled to the drum by a power transmission system for rotating the drum, and a power supply configured to supply power to the motor for a predetermined time and to shut off the power thereafter during a pre-dry operation of the clothes dryer. The control system further includes a photo coupler coupled to the motor to output voltage pulses when the motor is in operation after the power is shut off, and a microprocessor configured to measure a counter electromotive force generated by the motor during the pre-dry operation based on a frequency of the voltage pulses. The microprocessor detects a breakage of the power transmission system if the measured counter electromotive force is greater than a reference level. The microprocessor further performs a main dry operation of the clothes dryer only if no breakage of the power transmission system is detected during the pre-dry operation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
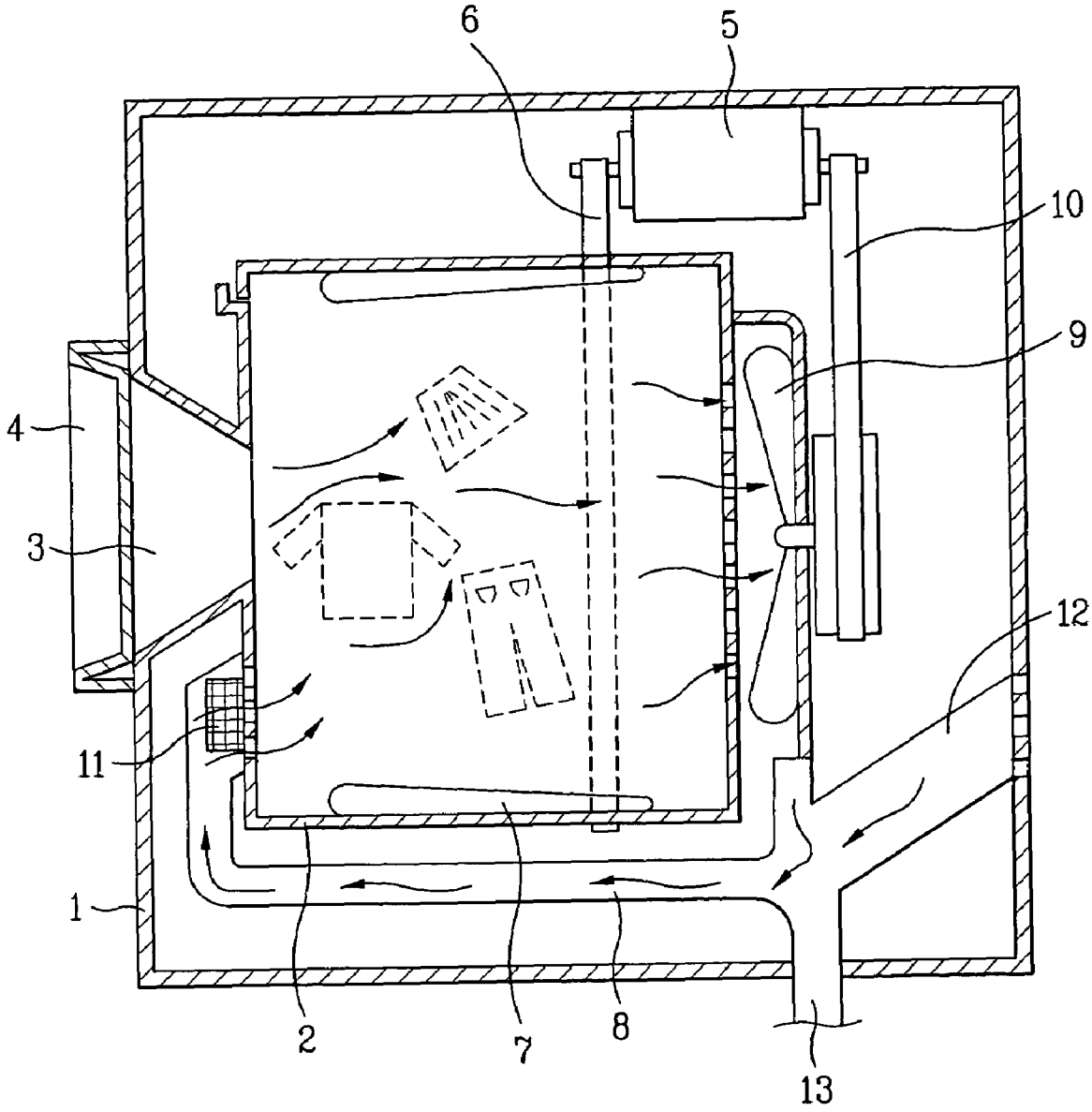
FIG. 1 illustrates an example of the belt-driven clothes dryer capable of detecting a belt breakage according to the present invention.

FIG. 1 illustrates an example of the belt-driven clothes dryer capable of detecting a belt breakage according to the present invention. According to FIG. 1, the dryer includes an outer case 1, a drum 2 rotatably provided within the outer case 1 and containing a load of wet clothes to be dried, an entrance 3 through which the clothes can be loaded into or removed from the drum 2, a door 4 which opens and closes the entrance 3. The dryer further includes an electric motor 5 which is mechanically coupled to the drum 2 by a power transmission system. For example, when the motor 5 rotates, a belt 6 mechanically coupled between the motor 5 and the drum 2 forces the drum 2 to rotate simultaneously. In addition, a plurality of lifters 7 are provided on an interior wall of the drum 2 so that the clothes are continuously lifted and evenly distributed inside the drum 2 when the drum 2 rotates during a dry operation.

The dryer shown in FIG. 1 further includes an air circulation duct 8 connected between an air outlet and an air inlet provided on the rear and front sides of the drum 2, respectively, for supplying heated dry air into the drum 2. In the air circulation duct 8, a heater 11 is provided near the air inlet 14 for heating the air flowing into the drum 2, and a fan 9 is provided near the air outlet for discharging the moisturized air from the drum 2 such that the air circulates through the air circulation duct 8. The fan 9 is also mechanically coupled to the motor 5. When the motor 5 rotates, a belt 6 coupled between the motor 5 and the belt 6 forces the fan 9 to rotate simultaneously. In addition, the dryer further includes an air supply duct 12 and a water discharge duct 13 coupled to the air circulation duct 8. The air supply duct 12 supplies outside air into the drum 2, and the water discharge duct 13 discharges the water condensed from the moisturized air circulating within the circulation duct 8.

Reference will now be made in detail to the preferred embodiments of the control systems and methods for a belt-driven dryer according to the present invention.

Figure 2:
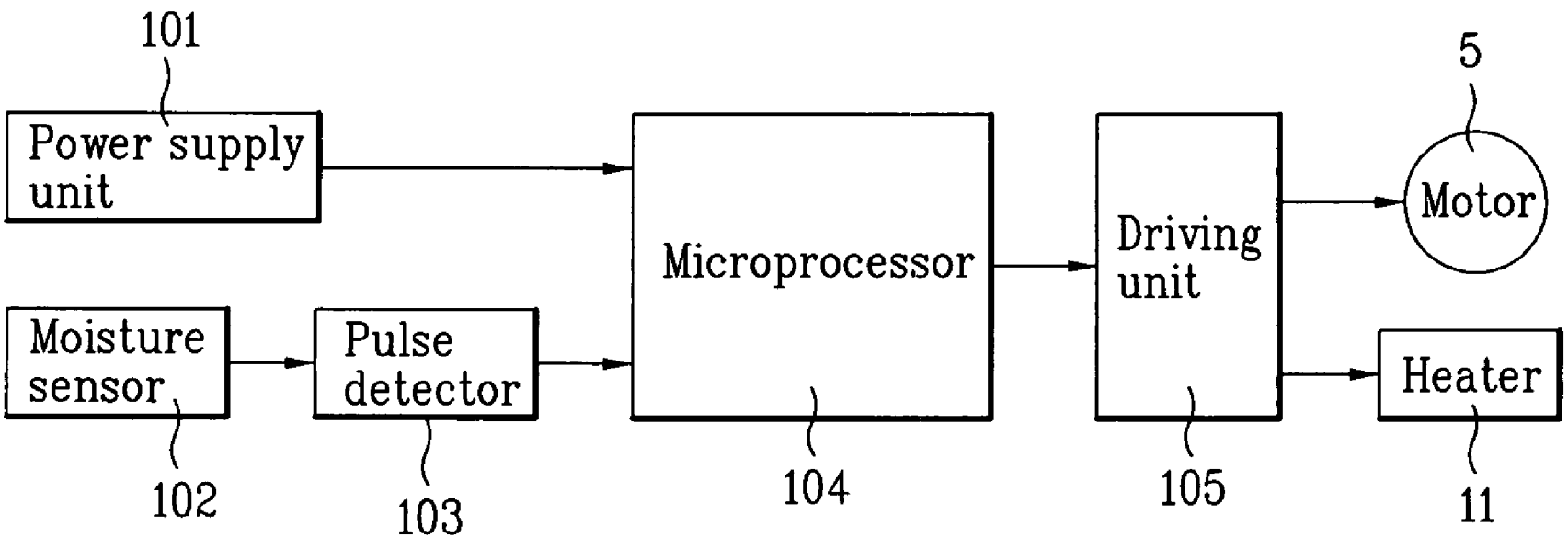
FIG. 2 illustrates a control system for a clothes dryer according to a first embodiment of the present invention.

FIG. 2 illustrates a control system for a belt-driven clothes dryer, an example of which is illustrated in FIG. 1, according to a first embodiment of the present invention. The control system shown in FIG. 2 includes a power supply unit 101 which supplies power to the motor 5 and the heater 11 during a dry operation of the clothe dryer. The control system further includes a moisture sensor 102 provided within the drum 2 for generating a voltage pulse each time it makes contact with the wet clothes during the dry operation, a pulse detector 103 detecting each voltage pulse generated by the moisture sensor 102 and generating a corresponding sensor signal, and a microprocessor 104 which detects a breakage of the belt 6 shown in FIG. 1 based upon analyzing the sensor signal received from the pulse detector 103. During the dry operation of the clothes dryer, the microprocessor 104 generate an interruption signal to a driving unit 105 which drives the motor 5 and the heater 11 if the belt breakage is detected. When the driving unit 105 receives the interruption signal, it automatically interrupts the dry operation of the dryer by shutting off the power being supplied to the motor 5 and the heater 11.

When the drum 2 of the belt-driven clothes dryer shown in FIG. 1 rotates during a dry operation, the wet clothes are continuously lifted and dropped within the drum 2. When a portion of the wet clothes makes contact with the moisture sensor 102 provided on the interior surface of the drum 2 during the dry operation, the moisture sensor 102 generates an analog voltage pulse indicating a moisture level of the portion of the clothes. When the portion of the wet clothes is in contact with the moisture sensor 102, a resistance of the moisture sensor 102 changes due to the moisture contents of the clothes in contact. Therefore, the amplitude of the voltage pulse indicates the moisture level of the portion of the clothes in contact. Thereafter, the pulse detector 103 detects the analog voltage pulses generated by the moisture sensor 102, and it generates a corresponding digital sensor signal including digital voltage pulses corresponding to the detected analog voltage pulses, respectively. Therefore, if there is no analog voltage pulse generated by the moisture sensor 102, the digital sensor signal does not include any digital voltage pulse.

Figure 3A:
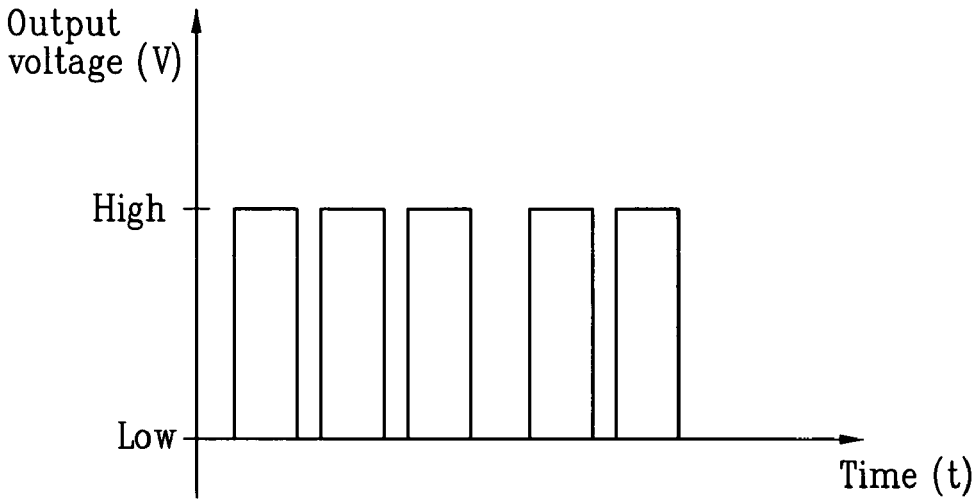
FIG. 3A illustrates an example of a sensor signal generated by the pulse detector 103 shown in FIG. 2 during a dry operation, where the belt 6 shown in FIG. 1 is in a normal condition.

If the belt 6 mechanically coupled between the motor 5 and the drum 2 is in a normal condition (e.g., no breakage) during the dry operation of the clothes dryer, the drum 2 containing the wet clothes rotates simultaneously with the motor 5 and the wet clothes are continuously lifted and dropped within the drum 2. FIG. 3A illustrates an example of the sensor signal generated by the pulse detector 103 during a dry operation, where the belt 6 is in a normal condition. As it is shown in the figure, the sensor signal includes a plurality of voltage pulses because the wet clothes continuously make contact with the moisture sensor 102. In other words, the amplitude of the sensor signal is High during the time a portion of the wet clothes is in contact with the moisture sensor 102. On other hand, the amplitude of the sensor signal is Low when the wet clothes are not in contact with the moisture sensor 102. Since the clothes are continuously lifted and dropped within the drum 2, the wet clothes continuously make contact with the moisture sensor 102 as shown in FIG. 3A.

Figure 3B:
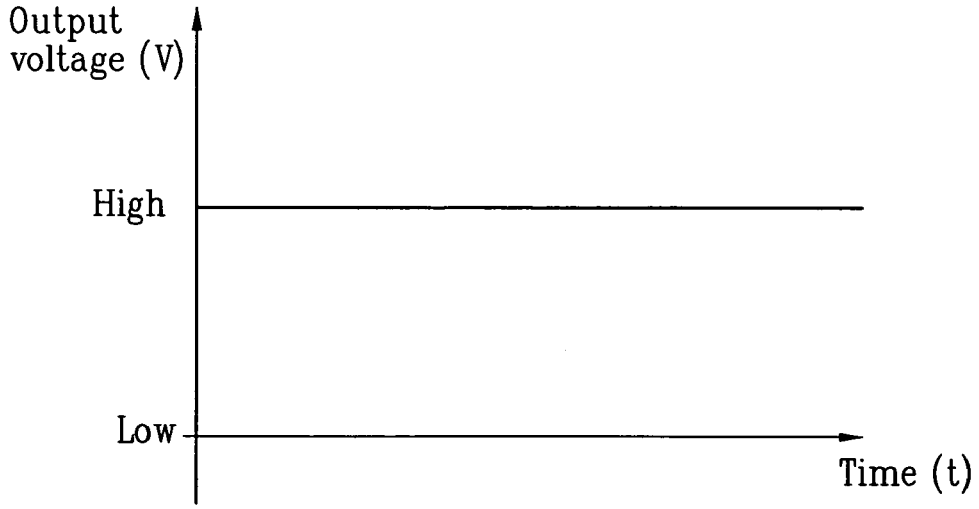
FIGS. 3B and 3C illustrate examples of sensor signals generated by the pulse detector 103 shown in FIG. 2 during a dry operation, where there is a breakage in the belt 6.
Figure 3C:
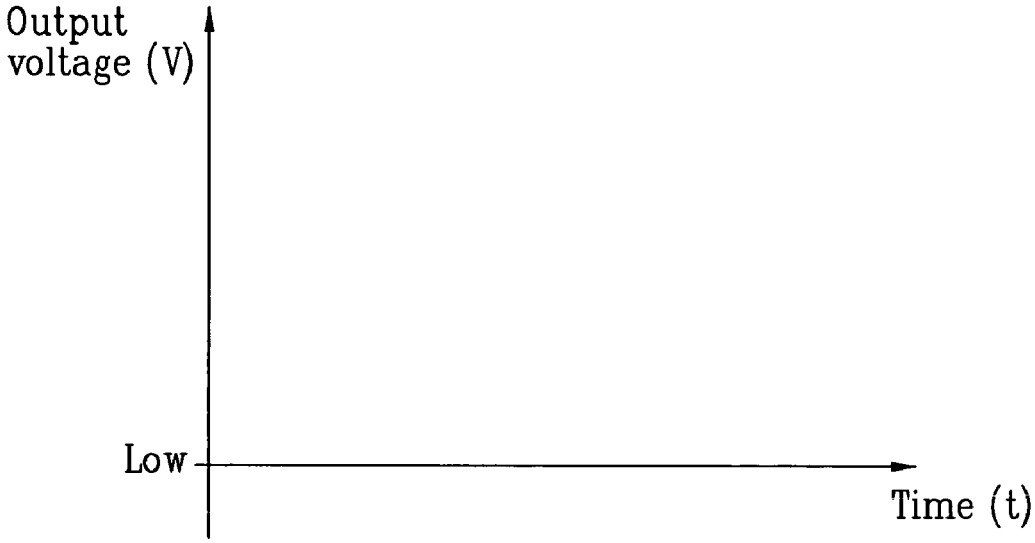

FIG. 3B and FIG. 3C illustrate examples of the sensor signals generated by the pulse detector 103 during a dry operation, where there is a breakage in the belt 6. If a breakage in the belt 6 exists, the power generated by the motor 5 is not properly transmitted to the drum 2. In other words, the drum 2 does not rotate during the dry operation, and there is no motion of the wet clothes within the drum 2. Therefore, there is no change in the sensor signal generated by the pulse detector 103 because there is no action within the drum 2. The amplitude of the sensor signal is continuously High if any portion of the wet clothes is in contact with the sensor as shown in FIG. 3B, or it is continuously Low if there is no contact between the clothes and the moisture sensor 102 as shown in FIG. 3C. The amplitude of the sensor signal remains unchanged since there is no motion of the drum 2 and the wet clothes.

Referring back to FIG. 2, the microprocessor 104 receives the sensor signal generated from the pulse detector 103 and determines whether a breakage in the belt 6 exists based upon analyzing the sensor signal. If a breakage of the belt 6 is detected, the microprocessor 104 interrupts the dry operation of the clothes dryer shown in FIG. 1 by transmitting interrupt signals to the driving unit 105. When the driving unit 105 receives the interrupt signals, it stops supplying power to the motor 5 and the heater 11 in order to prevent any damages. The microprocessor 104 detects a breakage of the belt 6 by determining whether there are changes in the sensor signal. If the amplitude of the sensor signal remain constant and there is no change in the sensor signal for a predetermined period of time, the microprocessor 104 determines that a breakage of the belt 6 exists, and it interrupts the dry operation of the dryer to avoid any damage to the motor 5, the heater 11, or the clothes within the drum 2. In addition, it may transmit a display control signal to a display unit (not illustrated) of the dryer shown in FIG. 1 in order to display a warning message indicative of the detected breakage of the power transmission system. Furthermore, it may transmit another control signal to a sound generating unit (not illustrated) of the dryer in order to generate warning sound (e.g., beep sound) such that a user could be easily informed of the breakage of the power transmission system.

Figure 4:
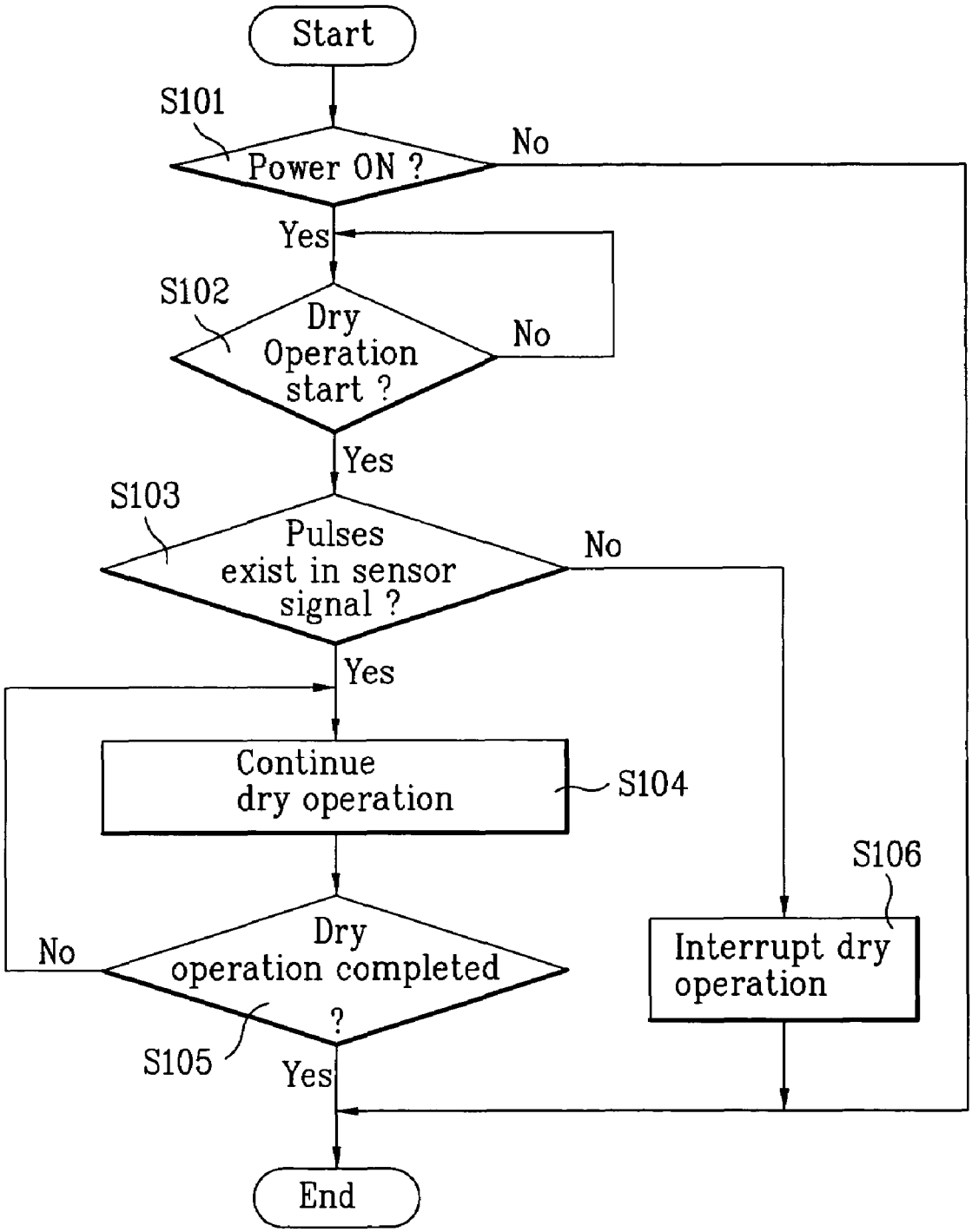
FIG. 4 illustrates a control method for a clothes dryer according to the first embodiment of the present invention.

FIG. 4 illustrates a control method of for a clothes dryer, an example of which is illustrated in FIG. 1, according to the first embodiment of the present invention. First of all, the microprocessor 104 shown in FIG. 2 included in the dryer shown in FIG. 1 determines whether a user inputs a command for powering on the dryer in step S101, and it further determines whether the user inputs a command for initiating a dry operation (e.g., activation of Start Key) in step S102. If the microprocessor 104 determines that both commands are inputted, it initiates a dry operation by transmitting corresponding control signals to the driving unit 105 for operating the motor 5 and the heater 11, and determines whether a breakage of the belt 6 exists (S103). In order to determine an existence of the breakage, the microprocessor 104 determines whether a portion of the sensor signal, which is received from the pulse detector 103 for a predetermined period of time, includes one or more voltage pulses.

If it is determined in step S103 that the portion of the sensor signal does include at least one voltage pulse or a predetermined number of voltage pulses, the microprocessor 104 determines that the belt 6 is in a normal condition (no breakage) and it continues performing the dry operation (S104). Thereafter, the microprocessor 104 further determines whether the dry operation is completed in step S105. On the other hand, if it is determined in step S103 that the amplitude of the sensor signal remain constant (no voltage pulse in the sensor signal) for the predetermined time, the microprocessor 104 determines that a breakage of the belt 6 exists and it interrupts the dry operation of the dryer by transmitting interrupt signals to the driving unit 105 (S106). When the driving unit 105 receives the interrupt signals, it stops supplying power to the motor 5 and the heater 11 in order to prevent any damages to the dryer. Additionally, the microprocessor 104 may further transmit a display control signal to the display unit of the dryer shown in FIG. 1 to display a warning message indicative of the breakage of the belt 6 in step S106. Similarly, it may further transmit a sound control signal to the sound generating unit of the dryer in order to generate warning sound for informing the user of the breakage of the belt 6 step S106.

As described above, the control system and the method of controlling operation for a dryer according to the first embodiment of the present invention provide an extremely, efficient way of detecting a breakage of the power transmission system of the dryer during a dry operation without using any additional mechanical system for detecting the breakage. For example, the microprocessor 104 of the control system shown in FIG. 2 uses the moisture sensor 102, which measures the moisture level of the clothes being dried for controlling the dry operation, to determine whether there is a breakage of the belt 6.

Figure 5:
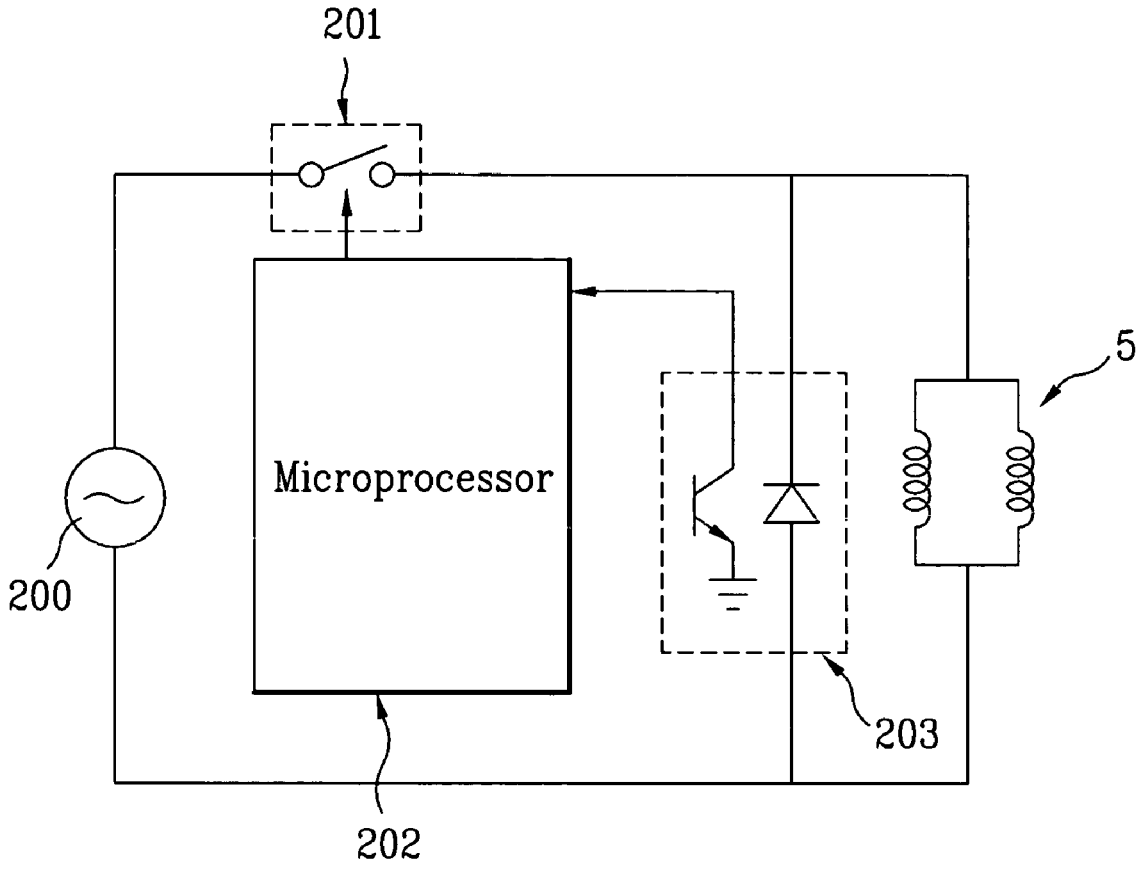
FIG. 5 illustrates a control system for a clothes dryer according to a second embodiment of the present invention.

FIG. 5 illustrates a control system (control circuit) for a belt-driven clothes dryer, an example of which is illustrated in FIG. 1, according to a second embodiment of the present invention. The control system shown in FIG. 5 includes a power supply unit 200 supplying power to the motor 5 and the heater 11 shown in FIG. 1 during a dry operation of the clothes dryer, a switch 201 which switches (turn on/off) the power being supplied to the motor 5 and the heater 11, and a photo coupler 203 coupled to the motor 5 to output voltage pulses when the motor 5 is in operation during the dry operation. The photo coupler 203 may include a light generating unit and a light sensing unit. The control system further includes a microprocessor 202 for detecting a breakage of the belt 6, which transmits the power generated by the motor 5 to the drum, upon analyzing the voltage pulses generated by the photo coupler 203 and for interrupting the dry operation of the clothes dryer if such breakage of the belt 6 is detected.

During a dry operation of the clothes dryer shown in FIG. 1, the switch 201 performs a switching function so that the power supply unit 200 supplies power to the motor 5, which is mechanically coupled to the drum 2 by the belt 6 for rotating the drum 2, and to the heater 11 for heating the air flowing into inside of the drum 2 for drying the wet clothes. When the motor 5 is in operation during the dry operation, the photo coupler 203 coupled to the motor 5 continuously generates a plurality of voltage pulses. In other words, when the motor 5 operates to rotate the belt 6, the photo coupler 203 detects the motion (rotation) of the motor 5 and outputs corresponding voltage pulses to the microprocessor 202, which determines whether a breakage of the belt 6 exists based on the voltage pulses outputted from the photo coupler 203.

Figure 6A:
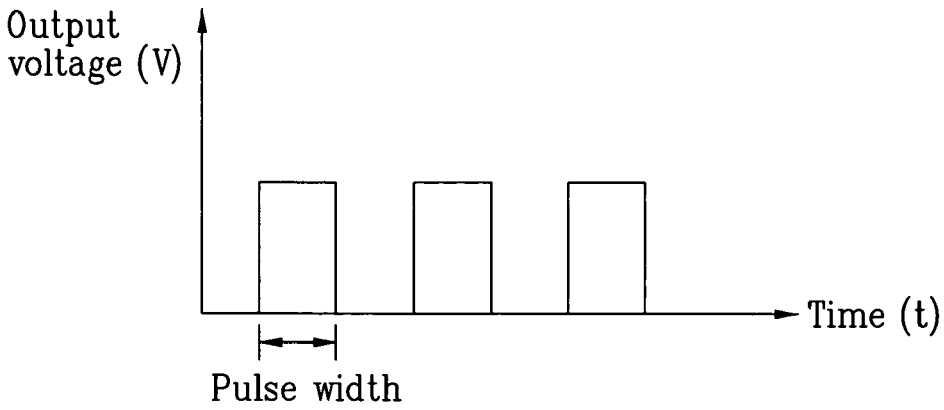
FIG. 6A illustrates an example of voltage pulses generated by the photo coupler 203 shown in FIG. 5, where the belt 6 shown in FIG. 1 is in a normal condition.
Figure 6B:
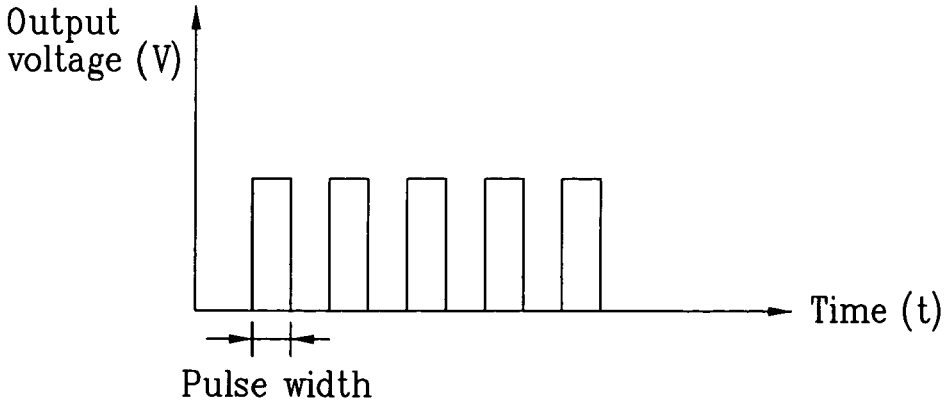
FIG. 6B illustrates an example of voltage pulses generated by the photo coupler 203 shown in FIG. 5, where there is a breakage in the belt 6.

FIG. 6A illustrates an example of the voltage pulses generated by the photo coupler 203, where the belt 6 is in a normal condition, and FIG. 6B illustrates an example of the voltage pulses generated, where there is a breakage in the belt 6. When there is a breakage in the belt 6, the belt 6 does not exert any force on the motor 5, and therefore, the motion of the motor 5 in the dry operation is comparatively faster. For this reason, the pulse width of the voltage pulses shown in FIG. 6B is less than that of the voltage pulses shown in FIG. 6B. In addition, the frequency of the pulses shown in FIG. 6B is greater than that of the pulses shown in FIG. 6A due to the same reason.

The microprocessor 202 may determine that a breakage of the belt 6 exists if the pulse width of the voltage pulses generated by the photo coupler 203 is less than a predetermined pulse width value (w1), which may be stored in a memory (not illustrated) coupled to the microprocessor 202. Alternatively, it may determine that a breakage of the belt 6 exists if the frequency of the voltage pulses generated by the photo coupler 203 is greater than a predetermined frequency value (f1), which may also be stored in the memory. When the microprocessor 202 determines that a breakage of the belt 6 exists, it interrupts the dry operation of the dryer by transmitting an interrupt signal to the switch 201 to shut off the power being supplied to the motor 5 and the heater 11 in order to prevent any damages to the dryer. In addition, it may transmit a display control signal to a display panel (not illustrated) of the dryer in order to display a warning message indicative of the breakage in the power transmission system of the dryer. Furthermore, it may transmit a sound control signal to a sound generating unit (not illustrated) of the dryer in order to generate warning sound (e.g., beep sound) such that the user could be easily informed of the breakage of the power transmission system.

Figure 7:
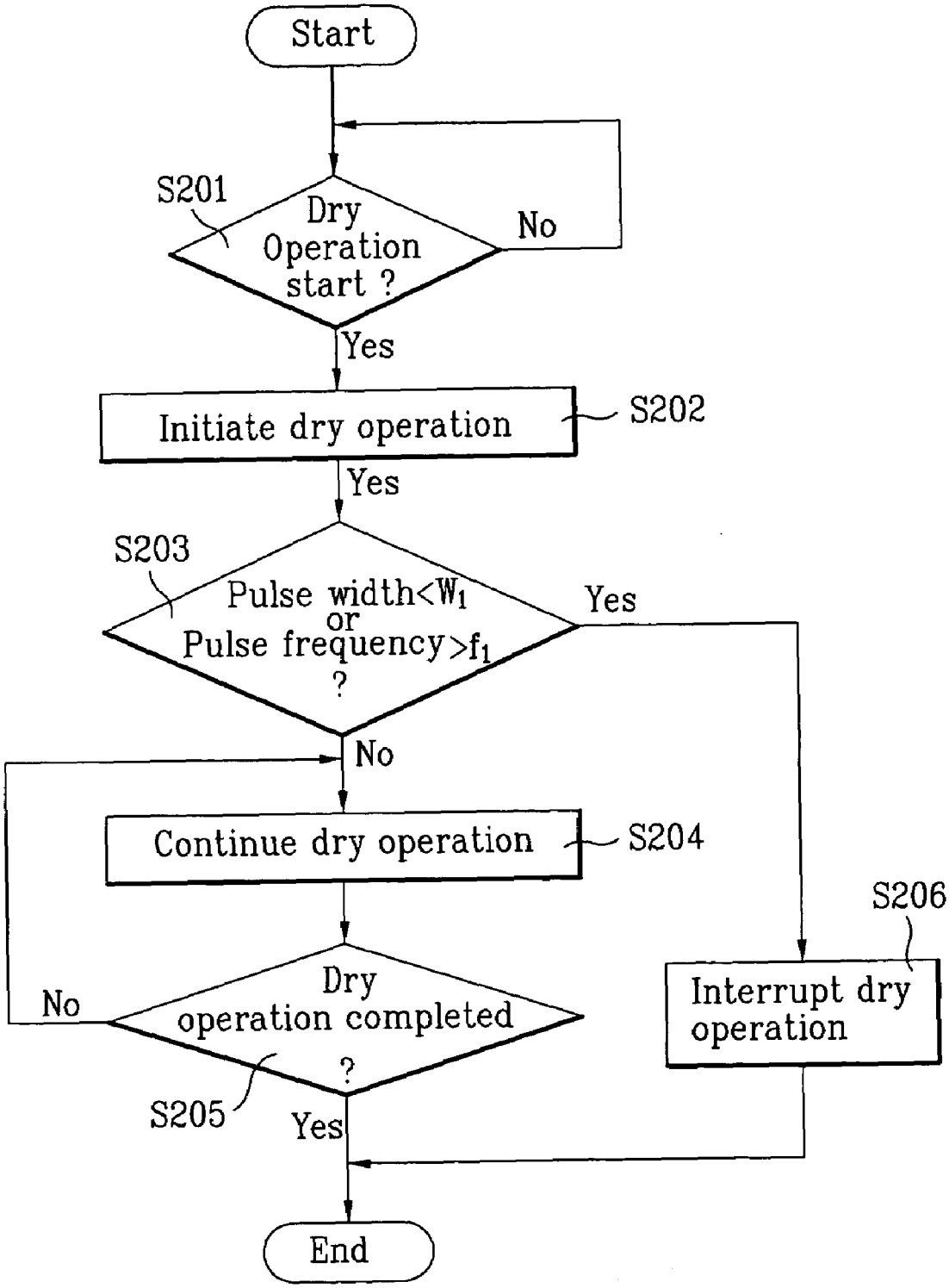
FIG. 7 illustrates a control method for a clothes dryer according to the second embodiment of the present invention.

FIG. 7 illustrates a control method for a belt-driven clothes dryer, an example of which is illustrated in FIG. 1, according to the second embodiment of the present invention. Referring to FIG. 7, the microprocessor 202 shown in FIG. 5 initially determines whether a user inputs a command for initiating a dry operation (e.g., activation of Start Key) in step S201. If the microprocessor 202 determines that the command is inputted, it initiates a dry operation of the dryer by transmitting a corresponding control signal to the switch 201 to supply power to the motor 5 and the heater 11 (S202). When the power is supplied in step S202, the motor 5 rotates the drum 2 containing a load of wet clothes and the heater 11 heats the air flowing into the drum 2, which is coupled to the belt 6 driven by the motor 5. During the dry operation of the dryer, the microprocessor 202 continuously receives voltage pulses, which are outputted from the photo coupler 203 when the motor 5 is in operation, and it determines whether a breakage of the belt 6 exists based upon analyzing the voltage pulses (S203). For example, the microprocessor 202 may detect the breakage if a pulse width of the voltage pulses is less than a predetermined reference pulse width value (w1). Alternatively, it may detect the breakage if a frequency of the voltage pulses is greater than a predetermined reference frequency value (f1).

If no breakage of the belt 2 is detected by the microprocessor 202 in step S203, it continues performing the dry operation of the dryer (S204). Thereafter, the microprocessor 202 further determines whether the dry operation is completed in step S205. On the other hand, if the breakage of the belt 2 is detected in step S203, the microprocessor 202 interrupts the dry operation of the dryer by transmitting interrupt signals to the switch 201 to shut off the power being supplied to the motor 5 and the heater 11 (S206). In step S206, the microprocessor 202 may additionally transmit a display control signal to the display panel of the dryer to display a warning message so as to inform a user of the detected breakage of the belt 6. Similarly, it may further transmit a sound control signal to the sound generating unit of the dryer for informing the user of the breakage of the belt 6.

Figure 8:
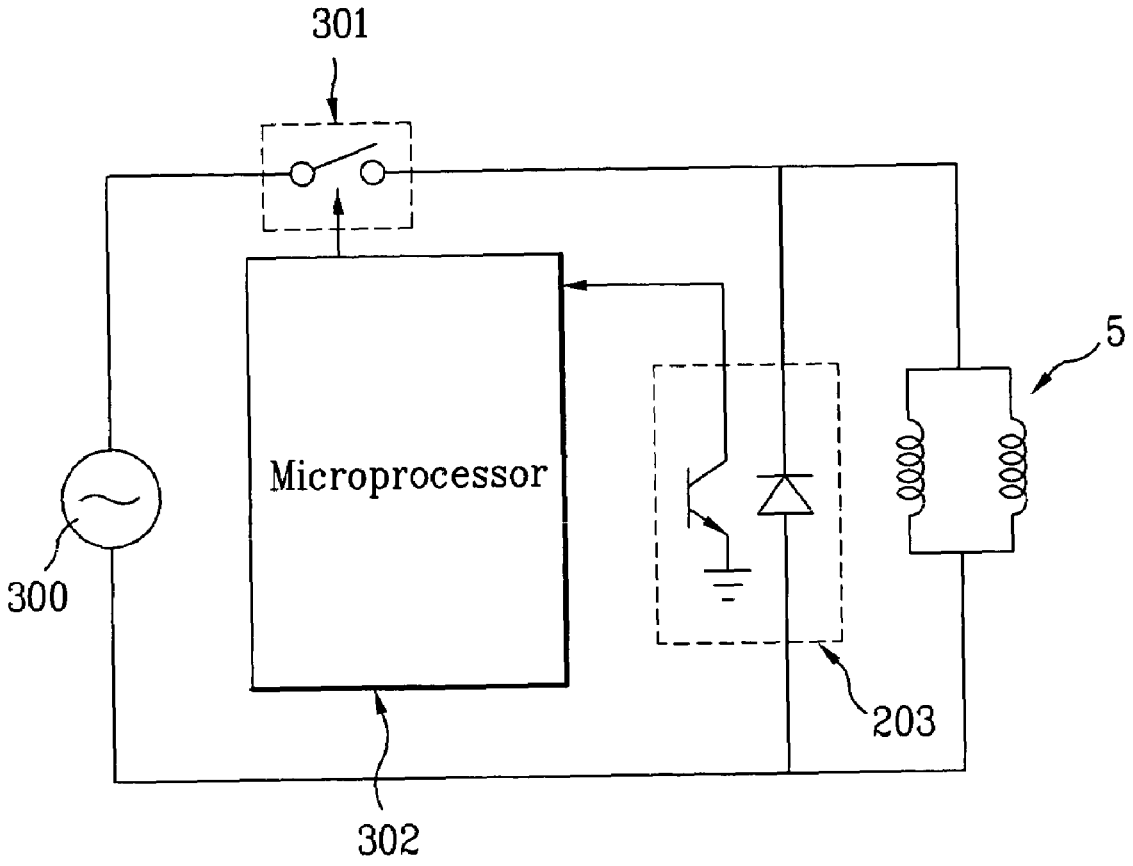
FIG. 8 illustrates a control system for a clothes dryer according to a third embodiment of the present invention.

FIG. 8 illustrates a control system (control circuit) for a belt-driven clothes dryer, an example of which is illustrated in FIG. 1, according to a third embodiment of the present invention. The control system shown in FIG. 8 illustrates a power supply unit 300 supplying power to the motor 5 during a pre-dry operation of the dryer shown in FIG. 1, a switch 301 which switches (turn on/off) the power being supplied by the power being supplied to the motor 5, and a photo coupler 303 coupled to the motor 5 to output voltage pulses when the motor 5 is in operation after the power is shut off by the switch 301 during the pre-dry operation. The photo coupler 303 may include a light generating unit and a light sensor unit. The control system further includes a microprocessor 302 for measuring a counter electromotive force generated by the motor 5 during the pre-dry operation based on a frequency of the voltage pulses. The microprocessor 302 detects a breakage of the belt 6 if the measured counter electromotive force is greater than a predetermined reference value.

During a pre-dry operation of the clothes dryer shown in FIG. 1, the microprocessor 302 transmits a switch control signal to the switch 301 to supply the power supplied by the power supply 300 to the motor 5, which is mechanically coupled to the drum 2 by the belt 6 for rotating the drum 2. After the speed of the drum 2 reaches a predetermined speed or a predetermined time is elapsed, the switche 301 shuts off the power being supplied to the motor 5 under the control of the microprocessor 302. After the power is shut off, the drum 2 containing the wet clothes continuously operates (rotates) for a while due to the tendency of the drum 2 to continue to rotate. During the time when the motor 2 is in motion with no power supply, the photo coupler 303 detects the motion (rotation) of the motor 5 and outputs corresponding voltage pulses to the microprocessor 302, which then measures a counter electromotive force generated by the motor 5 during the pre-dry operation based on a frequency of the voltage pulses.

When there is a breakage in the belt 6, the belt 6 does not exert any force on the motor 5. Therefore, the motion of the motor 5 during the pre-dry operation of the dryer is comparatively faster (higher frequency) and the counter electromotive fore generated by the motor 5 is comparatively higher. On the other hand, when the belt 6 is in a normal condition, the belt 6 coupled to the drum 2 exerts a force on the motor 5. Therefore, the motion of the motor 5 during the pre-dry operation is comparatively slower (lower frequency) and the counter electromotive force generated by the motor 5 is comparatively lower. The motions of the motor 5 in both cases are described and compared earlier in detail with reference to FIGS. 6A and 6B.

Due to the above reasons, the microprocessor 302 then detects a breakage of the belt 6 if the measured counter electromotive force is greater than a predetermined force value, which may be stored in a memory (not illustrated) coupled to the microprocessor 302. When the microprocessor 302 determines that no breakage of the belt 6 exists during the pre-dry operation, it generates control signals to perform a main dry operation of the clothes dryer, during which power is supplied to the motor 5 and the heater 11 configured to heat air flowing into the drum 2. In addition, it may transmit a display control signal to the display panel of the dryer in order to display a warning message indicative of the breakage of the power transmission system of the dryer. Furthermore, it may transmit a sound control signal to a sound generating unit (not illustrated) of the dryer in order to generate warning sound (e.g., beep sound) such that the user could be easily informed of such breakage.

Figure 9:
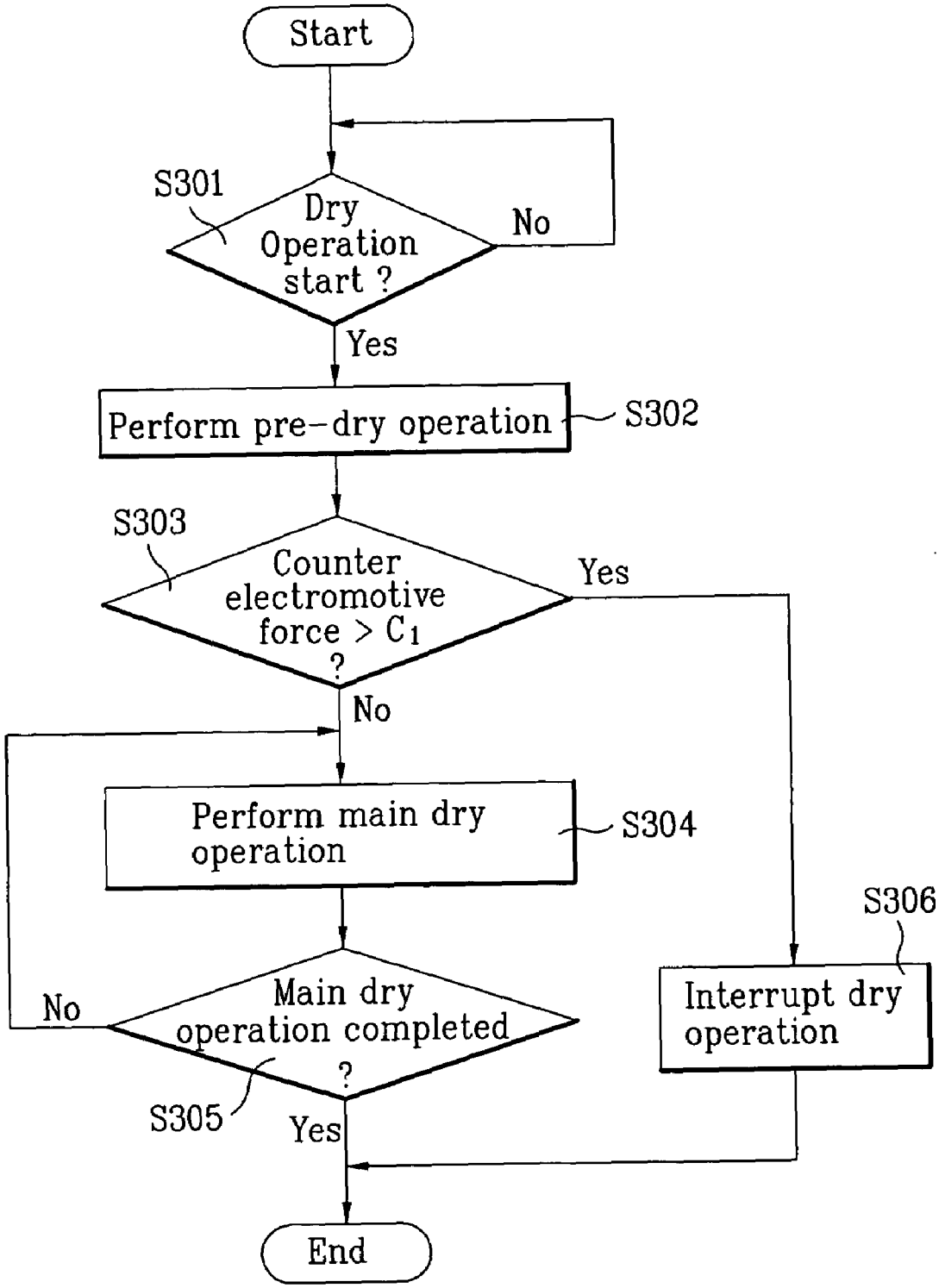
FIG. 9 illustrates a control method for a clothes dryer according to the third embodiment of the present invention.

FIG. 9 illustrates a control method for a belt-driven clothes dryer, an example of which is illustrated in FIG. 1, according to the third embodiment of the present invention. Referring to FIG. 9, the microprocessor 302 shown in FIG. 5 initially determines whether a user inputs a command for initiating a dry operation (e.g., activation of Start Key) in step S301. If the command is inputted, the microprocessor 302 initiates a dry operation of the clothes dryer by performing a pre-dry operation, during which power is supplied to the motor 5 for a predetermined period of time so as to accelerate the drum 2 containing a load of wet clothes, and the power is shut off thereafter (S302). During the pre-dry operation, the microprocessor measures a counter electromotive force generated by the motor 5 and compares the measured counter electromotive force with a predetermined force value (C1) to detect a breakage of the belt 6 (S303). The counter electromotive force may be measured in step S303 based on a frequency of voltage pulses, which are outputted from the photo coupler 303 coupled to the motor 5 when the motor is in operation during the pre-dry operation.

If the measured force is greater than the predetermined force value, the microprocessor 302 determines that there is a breakage of the belt 6 and interrupts the dry operation of the clothes dryer by shutting off the power supplies to the motor 5 and the heater 11 (S306). In step S306, the microprocessor 302 may additionally transmit a display control signal to the display panel of the dryer to display a warning message to inform a user of the detected breakage. Similarly, it may further transmit a sound control signal to the sound generating unit of the dryer for informing the user of the breakage of the belt 6. On the other hand, if the measured force is determined to be equal or less than the predetermined force value in step S303, the microprocessor 302 determines that there is no breakage in the belt 6 and continues the dry operation by performing a main dry operation (S304). During the main dry operation, the microprocessor 302 generates control signals to supply power to the motor 5 and the heater 11, which heats the air flowing into the drum 2.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control method for a clothes dryer, the method comprising:

performing a dry operation of the clothes dryer by supplying power to a motor for rotating a drum containing a load of wet clothes and to a heater heating air flowing into the drum, the drum being coupled to a power transmission system driven by the motor;

receiving voltage pulses outputted from a photo coupler coupled to the motor when the motor is in operation during the dry operation;

detecting a breakage of the power transmission system based upon analyzing the voltage pulses; and interrupting the dry operation of the clothes dryer if the breakage of the power transmission is detected.

2. The control method of claim 1, wherein the detecting a breakage of the power transmission system comprises detecting a breakage of the power transmission system if a pulse width of the voltage pulses is less than a reference pulse width.

3. The control method of claim 1, wherein the detecting a breakage of the power transmission system comprises detecting a breakage of the power transmission system if a frequency of the voltage pulses is greater than a reference frequency.

4. The control method of claim 1, further comprising displaying a warning message on a display panel so as to inform a user of the detected breakage of the power transmission system.

5. The control method of claim 1, wherein the interrupting the dry operation of the clothes dryer comprises shutting off the power being supplied to the motor and the heater.

6. A control system for a clothes dryer, the system comprising:

a drum containing a load of wet clothes to be dried;

a heater configured to heat air flowing into the drum;

a motor mechanically coupled to the drum by a power transmission system for rotating the drum;

a power supply configured to supply power to the motor and the heater during a dry operation of the clothes dryer;

a photo coupler configured to output voltage pulses when the motor is in operation during the dry operation; and a microprocessor configured to detect a breakage of the power transmission system based upon analyzing the voltage pulses outputted from the photo coupler and to interrupt the dry operation of the clothes dryer if the breakage is detected.

7. The control system of claim 6, wherein the microprocessor detects the breakage of the transmission system if a pulse width of the voltage pulses is less than a predetermined pulse width value.

8. The control system of claim 6, wherein the microprocessor detects the breakage of the transmission system if a frequency of the voltage pulses is greater than a predetermined frequency value.

9. The control system of claim 6, wherein the microprocessor transmits a display control signal to a display panel to display a warning message if the microprocessor detects the breakage of the power transmission system.

10. The control system of claim 6, the microprocessor interrupts the dry operation of the clothes dryer by transmitting an interrupt signal to a switch, which shuts off the power being supplied to the motor and the heater upon receiving the interrupt signal.

* * * * *